US007351067B2

(12) United States Patent
Chen et al.

(10) Patent No.: US 7,351,067 B2
(45) Date of Patent: Apr. 1, 2008

(54) COAXIAL CABLE CONNECTING APPARATUS

(75) Inventors: Li-Sen Chen, Gueishan Township, Taoyuan County (TW); Chuan-Shien Yu, Gueishan Township, Taoyuan County (TW); Wei-Hung Lin, Gueishan Township, Taoyuan County (TW)

(73) Assignee: Speed Tech Corp., Taoyuan County (TW)

( * ) Notice: Subject to any disclaimer, the term of this patent is extended or adjusted under 35 U.S.C. 154(b) by 0 days.

(21) Appl. No.: 11/500,932

(22) Filed: Aug. 9, 2006

(65) Prior Publication Data

US 2008/0038940 A1 Feb. 14, 2008

(51) Int. Cl.
*H01R 12/00* (2006.01)

(52) U.S. Cl. ..... 439/63; 439/581; 439/582

(58) Field of Classification Search ..... 439/63, 439/581, 582, 578, 394
See application file for complete search history.

(56) References Cited

U.S. PATENT DOCUMENTS 5,263,877 A * 11/1993 Mitani ..... 439/585
5,569,049 A * 10/1996 Tatebe et al. ..... 439/394
5,662,480 A * 9/1997 Togashi ..... 439/63
5,772,470 A * 6/1998 Togashi ..... 439/582
5,879,190 A * 3/1999 Maruyama et al. ..... 439/582
6,305,980 B2 * 10/2001 Ko ..... 439/582
6,340,312 B1 * 1/2002 Ko ..... 439/582
6,361,383 B1 * 3/2002 Ko ..... 439/856
6,431,915 B1 * 8/2002 Ko ..... 439/610
6,447,335 B1 * 9/2002 Ko ..... 439/585
6,503,100 B2 * 1/2003 Yamane ..... 439/582
6,508,668 B1 * 1/2003 Yamane ..... 439/582
6,533,610 B1 * 3/2003 Dai et al. ..... 439/581
6,572,407 B1 * 6/2003 Ko ..... 439/582
6,666,699 B2 * 12/2003 Uratani ..... 439/188
6,712,645 B1 * 3/2004 Chou ..... 439/582
6,739,907 B2 * 5/2004 Kuroda et al. ..... 439/582
6,837,743 B2 * 1/2005 Ko ..... 439/582
6,916,201 B1 * 7/2005 Chu ..... 439/582
6,971,913 B1 * 12/2005 Chu ..... 439/582
6,997,745 B2 * 2/2006 Ikeda ..... 439/582
7,008,235 B2 * 3/2006 Watanabe ..... 439/63
7,025,598 B2 * 4/2006 Ikeda ..... 439/63
7,186,142 B2 * 3/2007 Nagata et al. ..... 439/582
2002/0187660 A1 * 12/2002 Obayashi ..... 439/63
2005/0136700 A1 * 6/2005 Ikeda ..... 439/63
2005/0239328 A1 * 10/2005 Nagata et al. ..... 439/582
2006/0094297 A1 * 5/2006 Wang ..... 439/578

* cited by examiner

*Primary Examiner*—Renee Luebke
*Assistant Examiner*—Vanessa Girardi
(74) *Attorney, Agent, or Firm*—Troxell Law Office, PLLC

(57) ABSTRACT

A wire core of a coaxial cable is tightly bonded with a terminal. A pressing member is used to press the wire core toward the terminal. By doing so, better electrical characteristics are acquired.

7 Claims, 5 Drawing Sheets

COAXIAL CABLE CONNECTING APPARATUS

FIELD OF THE INVENTION

The present invention relates to a connecting apparatus; more particularly, relates to tightly bonding a terminal and a wire core to obtain better electrical characteristics.

DESCRIPTION OF THE RELATED ART

A prior art, called "A flat coaxial cable connector", is proclaimed in Taiwan. A plurality of terminals are inserted into a container of a shell. A contact member is located at an opening facing the shell. A pressing member is set at the opening to be capable of freely moving between an open position and a close position. The pressing member is corresponding to the coaxial cable set at the contact member, which is at the opposite side of the contact member. The open position is opened to be inserted with the flat coaxial cable into an insertion space at the opening. The insertion space is closed to press the flat coaxial cable toward the close position The pressing member is freely rotatable and is supported by a rotatable supporting member, where the supporting member is formed at a supporting frame kept on the shell. When the pressing member is positioned at the open position, the supporting member is formed at upper border of the supporting frame located outer to an inner surface of an upper wall of the shell.

Although the prior art firmly connects the flat coaxial cable and the shell, the connection can be loosened when applied to a round coaxial cable or a non-flat shape coaxial cable. Hence, the prior art does not fulfill users' requests on actual use.

SUMMARY OF THE INVENTION

The main purpose of the present invention is to depose a cable wire contacting to a terminal on a seat of a fixing member and to press the cable wire toward the terminal through a pressing member to tightly bond the cable wire and the terminal for better electrical characteristics.

To achieve the above purpose, the present invention is a coaxial cable connecting apparatus, comprising a shell having an embracing member and connecting to a cover plate on top rim; a fixing member being set in the embracing member and having a seat comprising a hole, an embraced member penetrated by the hole, and a pressing member being set on the seat near the hole; and a terminal being set in the hole of the seat and having a contacting plate with contact members at two sides to be set in the embraced member. Accordingly, a novel coaxial cable connecting apparatus is obtained.

BRIEF DESCRIPTIONS OF THE DRAWINGS

The present invention will be better understood from the following detailed description of the preferred embodiment according to the present invention, taken in conjunction with the accompanying drawings, in which FIG. 1 and FIG. 2 are the two perspective views showing the preferred embodiment according to the present invention;

DESCRIPTION OF THE PREFERRED EMBODIMENT

The following description of the preferred embodiment is provided to understand the features and the structures of the present invention.

Figure 1:
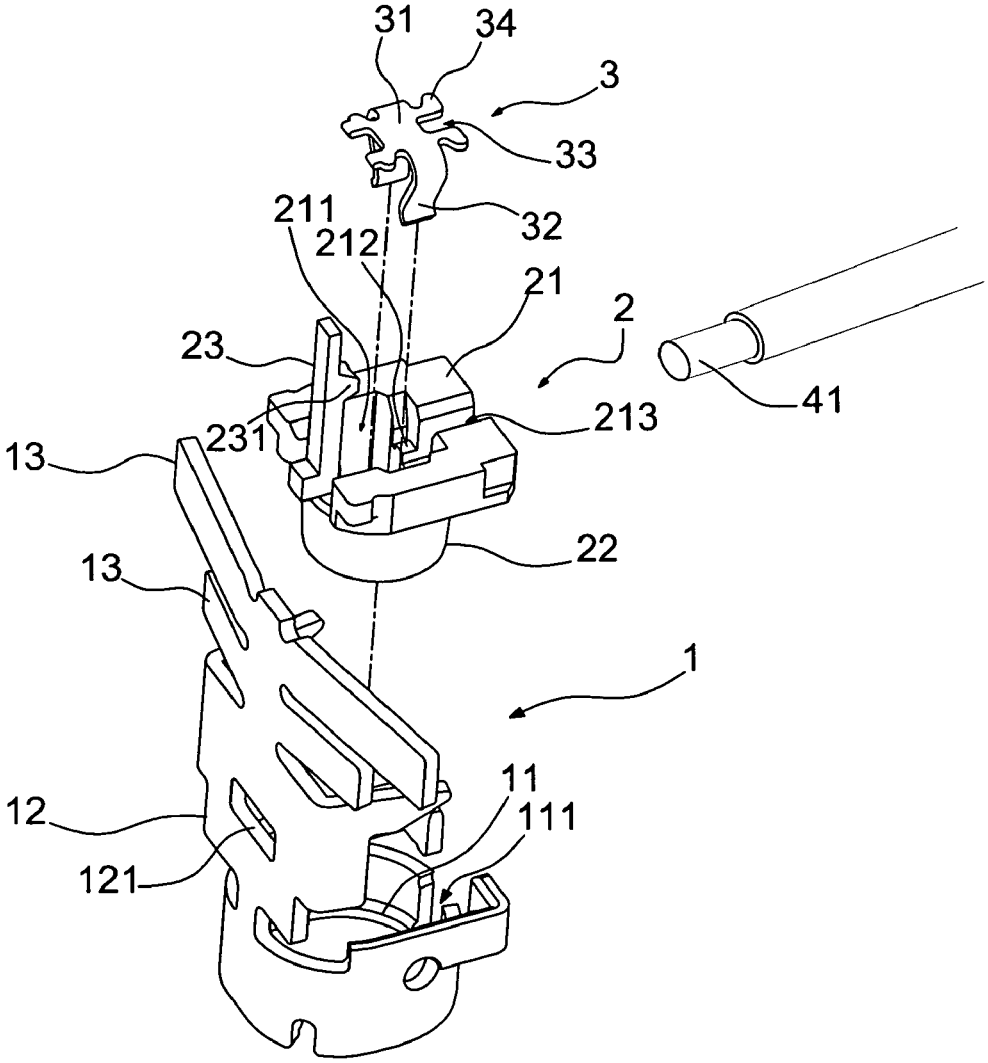
Figure 2:
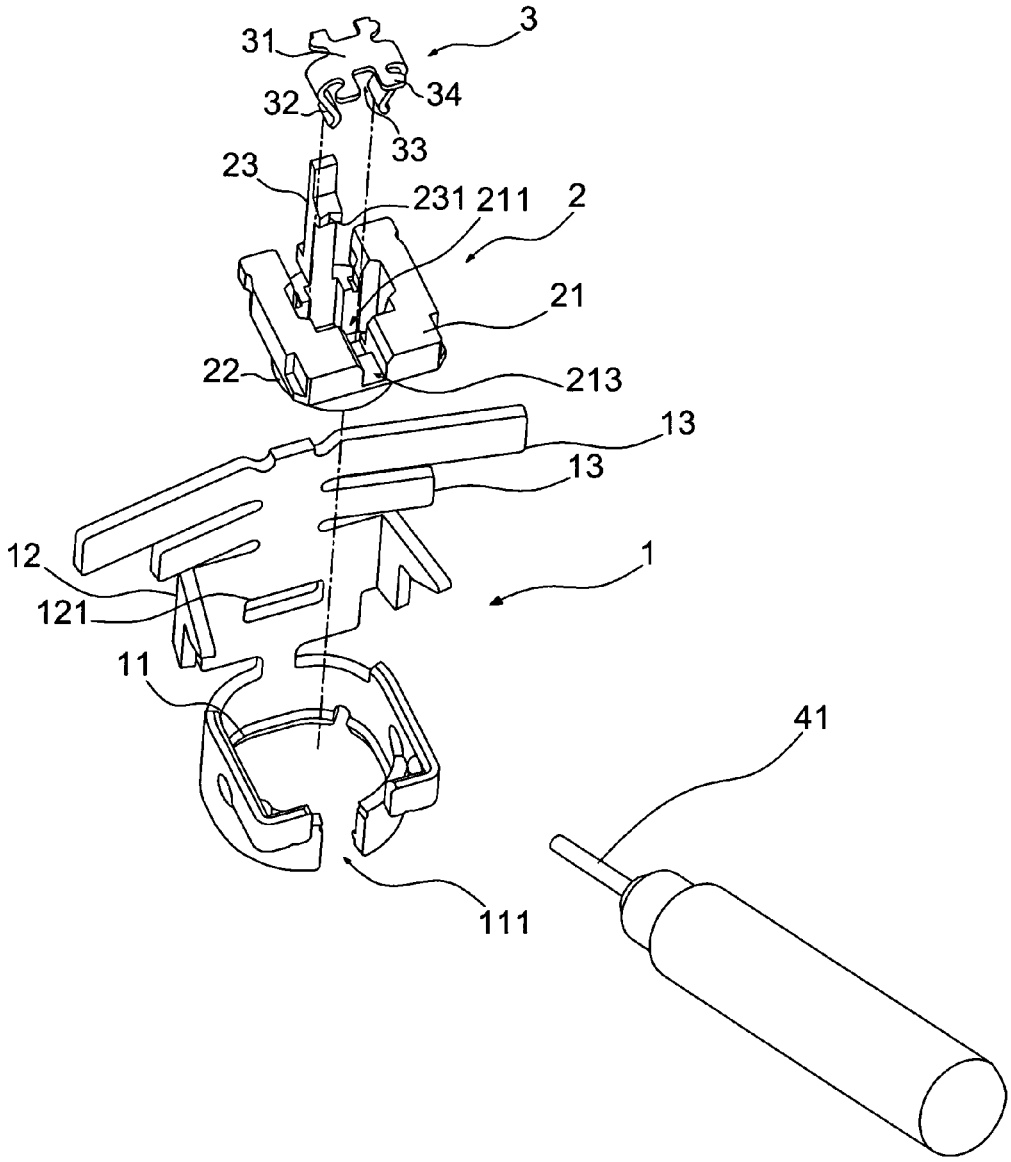

Please refer to FIG. 1 and FIG. 2 which are two perspective views showing a preferred embodiment according to the present invention. As shown in the figures, the present invention is a coaxial cable connecting apparatus, comprising a shell 1, a fixing member 2 and a terminal 3, where a wire core 41 is firmly bonded to a terminal 3 to acquire better electrical characteristics.

The shell 1 has an embracing member 11; the embracing member 11 has a cover plate 12 at an end; the cover plate 12 has a long hole 121 at a proper position; the embracing member 11 has a gap 111 at a side; and, the cover plate 12 has a cable clamp member 13 at the top rim.

The fixing member 2 is put in the embracing member 11; the fixing member 2 comprises a seat 21 having a hole 211, an embraced member 22 penetrated by the hole 211, and a pressing member 23 deposed on the seat 21 near the hole 211; the hole 211 is deposed with a stopper 212 on an inner surface; a concave 213 for holding a coaxial cable is on the seat 21, connecting to the hole 211 and corresponding to the pressing member 23; and, the pressing member 23 has a protrusion 231 on a surface corresponding to the hole 211.

The terminal 3 is put into the hole 211 of the seat 21 in the fixing member 2; the terminal 3 has a contacting plate 31; the contacting plate 31 extends out two contact members 32 from two sides separately to be set in the embraced member 22; the contacting plate 31 has at least an indentation 33 at an end; and the contacting plate 31 has two interference members 34 at two ends separately. Thus, a novel coaxial cable connecting apparatus is obtained.

Figure 3:
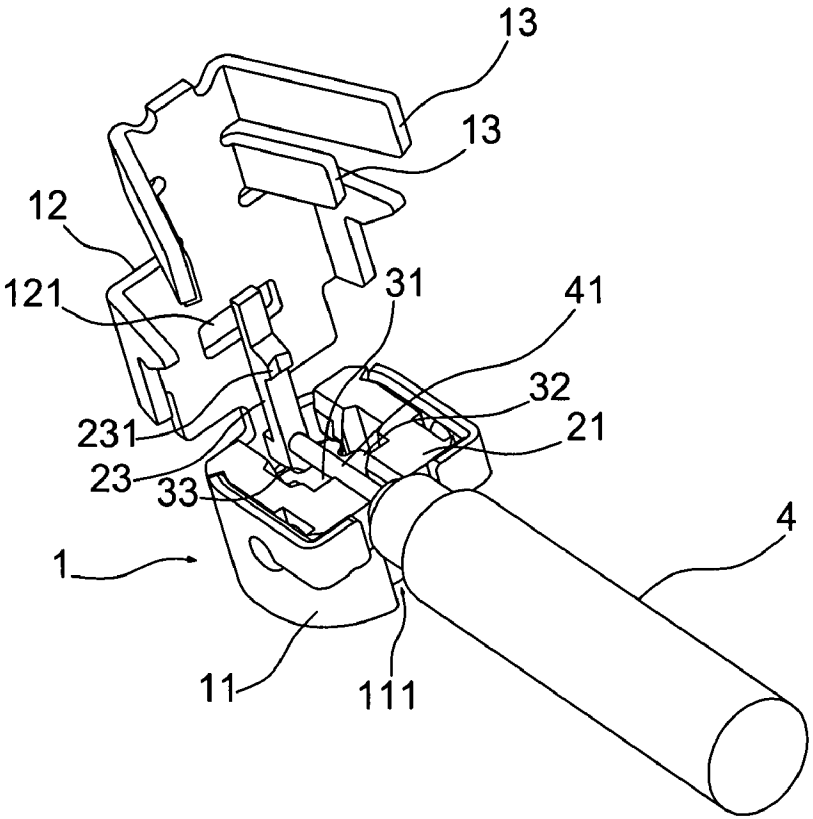
FIG. 3 is the view showing the status of assembling the preferred embodiment.
Figure 4:
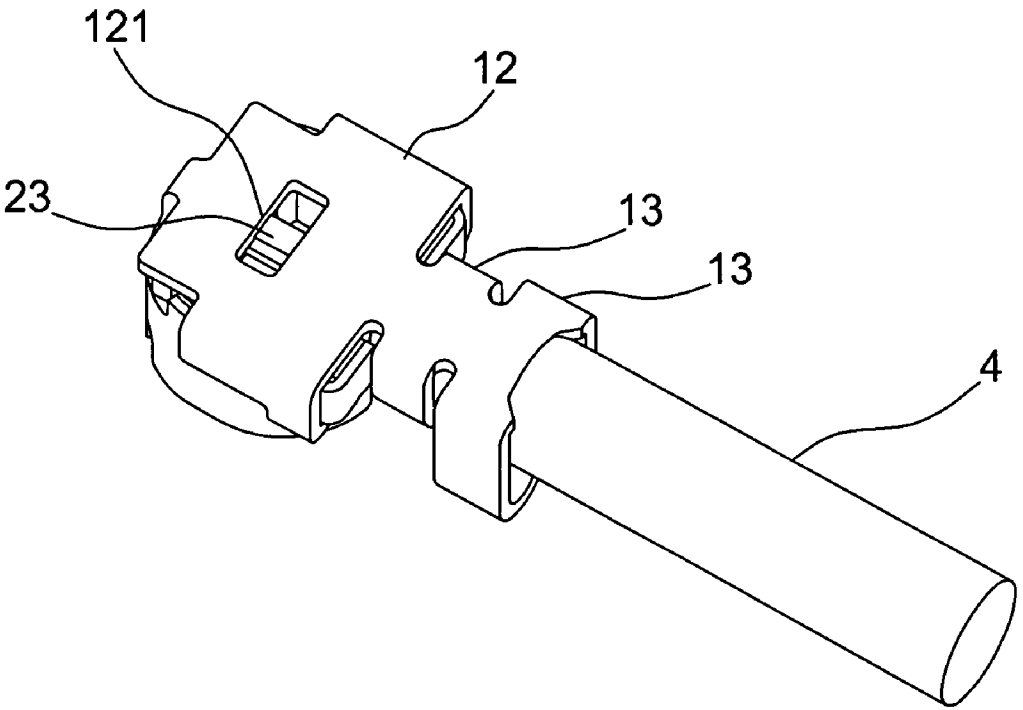
FIG. 4 is the perspective view showing the assembled preferred embodiment.
Figure 5:
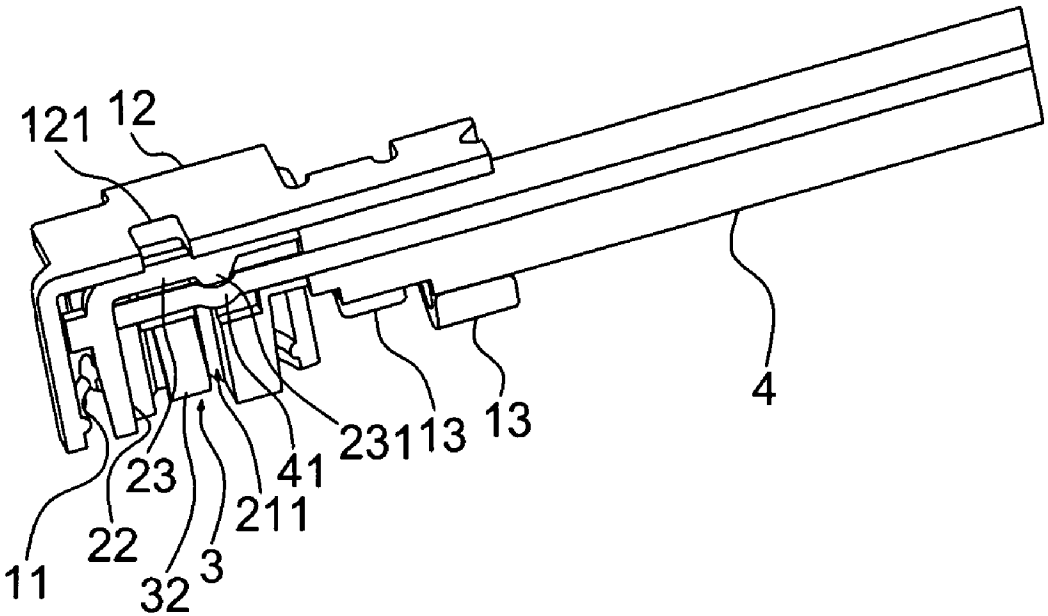
FIG. 5 is the sectional view.

Please refer to FIG. 3, FIG. 4 and FIG. 5, which are a view showing a status of assembling the preferred embodiment; and a perspective view and a sectional view showing the assembled preferred embodiment. As shown in the figures, when assembling the preferred embodiment, an embraced member 22 of a fixing member 2 is correspondingly put in to an embracing member 11 of a shell 1. A terminal 3 is set in a hole 211 of a seat 21 in the fixing member 2. Then, the terminal 3 uses two interference members 34 at two sides and the stopper 212 on the inner surface of the hole 211 for positioning. An indentation 33 on a contacting plate 31 of the terminal 3 is corresponding to a concave 213 of the seat 21. A leading wire 4, such as a coaxial cable, is deposed in the concave 213 of the seat 21 from a gap 111 of the embracing member 11. Hence, a wire core 41 of the leading wire 4 is contacted with the contacting plate 31 of the terminal 3 and is correspondingly located above the indentation 33. A pressing member 23 on the seat 21 is pressed toward the terminal 3 to press the wire core 41 down into the indentation 33 of the terminal 3 by a protrusion of a pressing member 23 for tightly bonding the terminal 3 and the wire core 41 through the pressing member 23. The leading wire 4 is further fixed by bonding the leading wire 4 with a cable clamp member 13 at rim of the shell 1. A cover plate 12 at an end of the embracing member 11 is drawn to cover the seat 21 of the fixing member 2 so that a long hole 121 of the cover plate 12 is vertically corresponding to the pressing member 23. If the pressing member 23 is departed from the default position owing to bad exertion on covering the cover plate 12, a required adjustment to the pressing member 23 can be done through the long hole 121 with a proper tool.

To sum up, the present invention is a coaxial cable connecting apparatus, where a wire core is deposed on a seat of a fixing member to connect to a terminal while a pressing member is used to press the wire core toward the terminal to tightly bond the terminal and the wire core for better electrical characteristics.

The preferred embodiment herein disclosed is not intended to unnecessarily limit the scope of the invention. Therefore, simple modifications or variations belonging to the equivalent of the scope of the claims and the instructions disclosed herein for a patent are all within the scope of the present invention.

What is claimed is:

1. A coaxial cable connecting apparatus, comprising:

a shell, said shell having an embracing member, said embracing member being connected to a cover plate at an end of said embracing member;

a fixing member, said fixing member being deposed in said embracing member, said fixing member comprising a seat, an embraced member and a pressing member, said seat having a hole, said embraced member being penetrated by said hole, said pressing member being located at said seat next to said hole; and a terminal, said terminal being located in said hole, said terminal having a contacting plate, said contacting plate having two contact members being extended from two sides of said contacting plate separately and being located in said embraced member, wherein said pressing member has a protrusion on a surface of said pressing member corresponding to said hole.

2. The apparatus according to claim 1, wherein said embracing member has a gap at a side of said embracing member.

3. The apparatus according to claim 1, wherein said cover plate has a cable clamp member.

4. The apparatus according to claim 1, wherein said cover plate has a long hole.

5. The apparatus according to claim 1, wherein said seat has a stopper on an inner surface of said hole.

6. The apparatus according to claim 1, wherein said seat comprises a concave being connected with said hole; and wherein said concave is corresponding to said pressing member.

7. The apparatus according to claim 1, wherein said contacting plate has an indentation located on at least one end of said contacting plate; and wherein said contacting plate has an interference member at two ends of said contacting plate separately.

* * * * *